US007686875B2

(12) United States Patent
Norkus et al.

(10) Patent No.: US 7,686,875 B2
(45) Date of Patent: Mar. 30, 2010

(54) ELECTROLESS DEPOSITION FROM NON-AQUEOUS SOLUTIONS

(75) Inventors: Eugenijus Norkus, Vilnius (LT); Jane Jaciauskiene, Vilnius (LT); Yezdi Dordi, Palo Alto, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 12/338,998

(22) Filed: Dec. 18, 2008

(65) Prior Publication Data

US 2009/0095198 A1 Apr. 16, 2009

Related U.S. Application Data

(63) Continuation-in-part of application No. 11/611,736, filed on Dec. 15, 2006, which is a continuation-in-part of application No. 11/427,266, filed on Jun. 28, 2006, now Pat. No. 7,297,190, and a continuation-in-part of application No. 11/382,906, filed on May 11, 2006, now Pat. No. 7,306,662.

(51) Int. Cl.
*C23C 18/38* (2006.01)

(52) U.S. Cl. ..... 106/1.23; 106/1.26

(58) Field of Classification Search ..... 106/1.23, 106/1.26

See application file for complete search history.

(56) References Cited

U.S. PATENT DOCUMENTS

| | | | | | |
|---|---|---|---|---|---|
| 3,635,761 | A * | 1/1972 | Haag et al. | ..... | 106/1.23 |
| 3,653,953 | A * | 4/1972 | Grant et al. | ..... | 106/1.26 |
| 3,962,494 | A * | 6/1976 | Nuzzi | ..... | 106/1.26 |
| 4,301,196 | A * | 11/1981 | McCormack et al. | ..... | 106/1.23 |
| 4,908,241 | A * | 3/1990 | Quast et al. | ..... | 427/437 |
| 5,776,231 | A * | 7/1998 | Nittel et al. | ..... | 106/1.23 |
| 6,291,025 | B1 * | 9/2001 | Tepper et al. | ..... | 427/96.6 |
| 6,709,555 | B1 * | 3/2004 | Ogure et al. | ..... | 204/224 R |
| 7,147,767 | B2 * | 12/2006 | Boyd et al. | ..... | 106/1.26 |
| 7,297,190 | B1 * | 11/2007 | Dordi et al. | ..... | 106/1.23 |
| 7,306,662 | B2 * | 12/2007 | Vaskelis et al. | ..... | 106/1.23 |
| 2007/0264436 | A1 * | 11/2007 | Dordi et al. | ..... | 427/443.1 |

* cited by examiner

*Primary Examiner*—Helene Klemanski
(74) *Attorney, Agent, or Firm*—Martine Penilla & Gencarella, LLP

(57) ABSTRACT

A non-aqueous electroless copper plating solution that includes an anhydrous copper salt component, an anhydrous cobalt salt component, a non-aqueous complexing agent, and a non-aqueous solvent is provided.

18 Claims, 2 Drawing Sheets

ELECTROLESS DEPOSITION FROM NON-AQUEOUS SOLUTIONS

CLAIM OF PRIORITY

This application is a continuation in part and claims priority to U.S. patent application Ser. No. 11/611,736 filed Dec. 15, 2006, and entitled "Apparatus for Applying a Plating Solution for Electroless Deposition," which is a continuation in part of U.S. application Ser. No. 11/382,906, now U.S. Pat. No. 7,306,662, filed May 11, 2006 entitled "Plating Solution for Electroless Deposition of Copper," and U.S. application Ser. No. 11/427,266, now U.S. Pat. No. 7,297,190, filed Jun. 28, 2006 entitled "Plating Solutions for Electroless Deposition of Copper." The disclosure of each of these applications is incorporated herein by reference in their entireties for all purposes.

BACKGROUND

In the fabrication of semiconductor devices such as integrated circuits, memory cells, and the like, involve a series of manufacturing operations that are performed to define features on semiconductor wafers ("wafers"). The wafers include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

To build an integrated circuit, transistors are first created on the surface of the wafer. The wiring and insulating structures are then added as multiple thin-film layers through a series of manufacturing process steps. Typically, a first layer of dielectric (insulating) material is deposited on top of the formed transistors. Subsequent layers of metal (e.g., copper, aluminum, etc.) are formed on top of this base layer, etched to create the conductive lines that carry the electricity, and then filled with dielectric material to create the necessary insulators between the lines. The process used for producing copper lines is referred to as a dual Damascene process, where trenches are formed in a planar conformal dielectric layer, vias are formed in the trenches to open a contact to the underlying metal layer previously formed, and copper is deposited everywhere. Copper is then planarized (overburden removed), leaving copper in the vias and trenches only.

Although copper lines are typically comprised of a plasma vapor deposition (PVD) seed layer (i.e., PVD Cu) followed by an electroplated layer (i.e., ECP Cu), electroless chemistries are under consideration for use as a PVD Cu replacement, and even as an ECP Cu replacement. An electroless copper deposition process can thus be used to build the copper conduction lines. During electroless copper deposition, electrons are transferred from a reducing agent to the copper ions resulting in the deposition of reduced copper onto the wafer surface. The formulation of the electroless copper plating solution is optimized to maximize the electron transfer process involving the copper ions.

Conventional formulations call for maintaining the electroless plating solution at a high alkaline pH (i.e., pH>9) to enhance the overall deposition rate. The limitations with using highly alkaline copper plating solutions for electroless copper deposition are non-compatibility with positive photoresist on the wafer surface, longer induction times, and decreased nucleation density due to an inhibition by hydroxylation of the copper interface (which occurs in neutral-to-alkaline environments). These are limitations that can be eliminated if the solution is maintained at an acidic pH environment (i.e., pH<7). One prominent limitation found with using acidic electroless copper plating solutions is that certain substrate surfaces, such as tantalum nitride (TaN), tend to get oxidized readily in an alkaline environment causing adhesion problems for the reduced copper resulting in blotchy plating on the TaN surfaces of the wafer.

In addition, many of the typical electroless deposition solutions utilize an aqueous base solution. However, for certain metal layers, the addition of water may cause oxidation of the layer, which is undesirable.

It is within this context that the embodiments arise.

SUMMARY

Broadly speaking, the present invention fills these needs by providing a formulation for a non aqueous solution for electroless depositions. It should be appreciated that the present invention can be implemented in numerous ways, including as a method and a chemical solution. Several inventive embodiments of the present invention are described below.

In one exemplary embodiment, a non-aqueous electroless copper plating solution is provided. The electroless plating solution includes an anhydrous copper salt component, an anhydrous cobalt salt component, a polyamine complexing agent, a halide source, and a non-aqueous solvent.

In another aspect of the invention, a non-aqueous electroless copper plating solution that includes an anhydrous copper salt component, an anhydrous cobalt salt component, a non-aqueous complexing agent, and a non-aqueous solvent is provided.

It will be obvious, however, to one skilled in the art, that embodiments of the present invention may be practiced without some or all of these specific details. In other instances, well known process operations have not been described in detail in order not to obscure the present invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION

Figure 1:
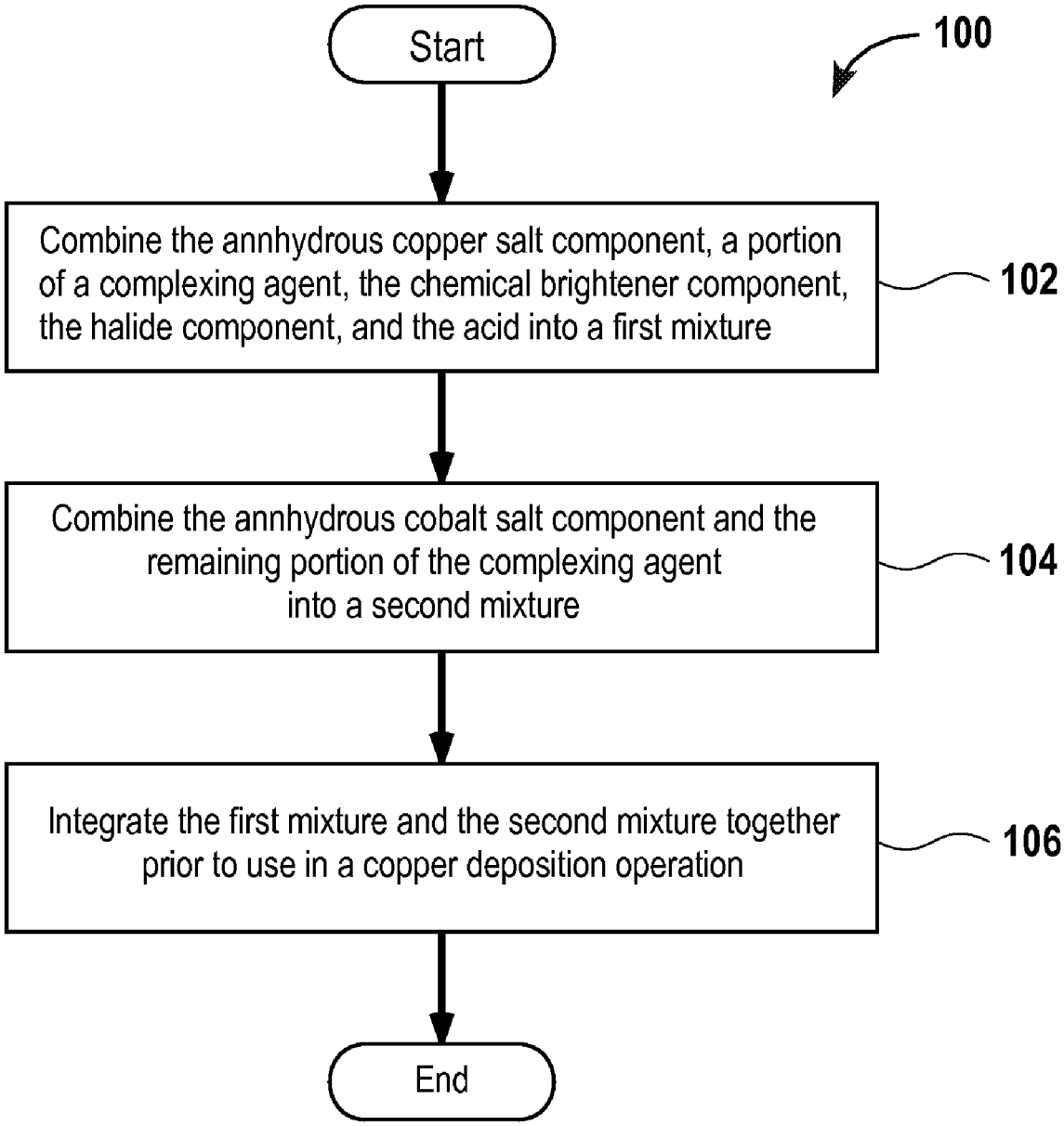
FIG. 1 is a flow chart of a method for preparing an electroless copper plating solution, in accordance with one embodiment of the present invention.

An invention is described for providing improved formulations of electroless copper plating solutions that can be maintained in an acidic pH to weakly alkaline environment for use in electroless copper deposition processes and for non aqueous formulations for electroless plating solutions. It should be appreciated that while specific plating solutions are described herein, the chamber may be used for any plating solution and is not limited for use with the specifically mentioned plating solutions. It will be obvious, however, to one skilled in the art, that the present invention may be practiced without some or all of these specific details. In other instances, well known process operations have not been described in detail in order not to unnecessarily obscure the present invention.

Electroless metal deposition processes used in semiconductor manufacturing applications are based upon simple electron transfer concepts. The processes involve placing a prepared semiconductor wafer into an electroless metal plating solution bath then inducing the metal ions to accept electrons from a reducing agent resulting in the deposition of the reduced metal onto the surface of the wafer. The success of the electroless metal deposition process is highly dependent upon the various physical (e.g., temperature, etc.) and chemical (e.g., pH, reagents, etc.) parameters of the plating solution. As used herein, a reducing agent is an element or compound in an oxidation-reduction reaction that reduces another compound or element. In doing so, the reducing agent becomes oxidized. That is, the reducing agent is an electron donor that donates an electron to the compound or element being reduced.

A complexing agent (i.e., chelators or chelating agent) is any chemical agent that can be utilized to reversibly bind to compounds and elements to form a complex. A salt is any ionic compound composed of positively charged cations (e.g., $Cu^{2+}$, etc.) and negatively charged anions, so that the product is neutral and without a net charge. A simple salt is any salt species that contain only one kind of positive ion (other than the hydrogen ion in acid salts). A complex salt is any salt species that contains a complex ion that is made up of a metallic ion attached to one or more electron-donating molecules. Typically a complex ion consists of a metallic atom or ion to which is attached one or more electron-donating molecules (e.g., Cu(II)ethylenediamine$^{2+}$, etc.). A protonized compound is one that has accepted a hydrogen ion (i.e., $H^+$) to form a compound with a net positive charge.

A copper plating solution for use in electroless copper deposition applications is disclosed below. The components of the solution are a copper(II) salt, a cobalt(II) salt, a chemical brightener component, and a polyamine-based complexing agent. In one exemplary embodiment, the copper plating solution is prepared using de-oxygenated liquids. Use of de-oxygenated liquids substantially eliminates oxidation of the wafer surfaces and nullifies any effect that the liquids may have on the redox potential of the final prepared copper plating solution. In one embodiment, the copper plating solution further includes a halide component. Examples of halide species that can be used include fluoride, chloride, bromide, and iodide.

In one embodiment, the copper(II) salt is a simple salt. Examples of simple copper(II) salts include copper(II) sulfate, copper (II) nitrate, copper(II) chloride, copper(II) tetrafluoroborate, copper(II) acetate, and mixtures thereof. It should be appreciated that essentially any simple salt of copper(II) can be used in the solution so long as the salt can be effectively solubilized into solution, be complexed by a polyamine-based complexing agent, and oxidized by a reducing agent in an acidic environment to result in deposition of the reduced copper onto the surface of the wafer.

In one embodiment, the copper(II) salt is a complex salt with a polyamine electron-donating molecule attached to the copper(II) ion. Examples of complex copper(II) salts include copper(II) ethylenediamine sulfate, bis(ethylenediamine) copper(II) sulfate, copper(II) diethylenetriamine nitrate, bis (diethylenetriamine)copper(II) nitrate, and mixtures thereof. It should be appreciated that essentially any complex salt of copper(II) attached to a polyamine molecule can be used in the solution so long as the resulting salt can be solubilized into solution, be complexed to a polyamine-based complexing agent, and oxidized by a reducing agent in an acidic environment to result in deposition of the reduced copper onto the surface of the wafer.

In one embodiment, the concentration of the copper(II) salt component of the copper plating solution is maintained at a concentration of between about 0.0001 molarity (M) and the solubility limit of the various copper(II) salts disclosed above. In another exemplary embodiment, the concentration of the copper(II) salt component of the copper plating solution is maintained at between about 0.001 M and 1.0 M or the solubility limit. It should be understood that the concentration of the copper(II) salt component of the copper plating solution can essentially be adjusted to any value up to the solubility limit of the copper(II) salt as long as the resulting copper plating solution can effectuate electroless deposition of copper on a wafer surface during an electroless copper deposition process.

In one embodiment, the cobalt(II) salt is a simple cobalt salt. Examples of simple cobalt(II) salts include cobalt(II) sulfate, cobalt(II) chloride, cobalt(II) nitrate, cobalt(II) tetrafluoroborate, cobalt(II) acetate, and mixtures thereof. It should be understood that essentially any simple salt of cobalt (II) can be used in the solution so long as the salt can be effectively solubilized in the solution, be complexed to a polyamine-based complexing agent, and reduce a cobalt(II) salt in an acidic environment to result in the deposition of the reduced copper onto the surface of the wafer.

In another embodiment, the cobalt(II) salt is a complex salt with a polyamine electron-donating molecule attached to the cobalt(II) ion. Examples of complex cobalt(II) salts include cobalt(II) ethylenediamine sulfate, bis(ethylenediamine)cobalt(II) sulfate, cobalt(II) diethylenetriamine nitrate, bis(diethylenetriamine)cobalt(II) nitrate, and mixtures thereof. It should be understood that essentially any simple salt of cobalt (II) can be used in the solution so long as the salt can be effectively solubilized into solution, be complexed to a polyamine-based complexing agent, and reduce a copper(II) salt in an acidic environment to result in the deposition of the reduced copper onto the surface of the wafer.

In one embodiment, the concentration of the cobalt (II) salt component of the copper plating solution is maintained at between about 0.0001 molarity (M) and the solubility limit of the various cobalt(II) salt species disclosed above. In one exemplary embodiment, the concentration of the cobalt(II) salt component of the copper plating solution is maintained at between about 0.001 M and 1.0 M. It should be understood that the concentration of the cobalt(II) salt component of the copper plating solution can essentially be adjusted to any value up to the solubility limit of the cobalt(II) salt as long as the resulting copper plating solution can effectuate electroless deposition of copper on a wafer surface at an acceptable rate during an electroless copper deposition process.

In one embodiment, the chemical brightener component works within the film layer to control copper deposition on a microscopic level. The brightener tends to be attracted to points of high electro-potential, temporarily packing the area and forcing copper to deposit elsewhere in this embodiment. It should be appreciated that as soon as the deposit levels, the local point of high potential disappears and the brightener drifts away, i.e., brighteners inhibit the normal tendency of the copper plating solution to preferentially plate areas of high potential which would inevitably result in rough, dull plating. By continuously moving between surfaces with the highest potential, brighteners (also referred to as levelers) prevent the formation of large copper crystals, giving the highest possible packing density of small equiaxed crystals (i.e., nucleation enhancement), which results in a smooth, glossy, high ductility copper deposition in this embodiment. One exemplary brightener is bis-(3-sulfopropyl)-disulfide disodium salt (SPS), however, any small molecular weight sulfur containing compounds that increase the plating reaction by displacing an adsorbed carrier may function in the embodiments described herein. In one embodiment, the concentration of the chemical brightener component is maintained at between about 0.000001 molarity (M) and the solubility limit for the brightener. In another embodiment, the chemical brightener component has a concentration of between about 0.000001 M and about 0.01 M. In still another embodiment, the chemical brightener has a concentration of about between 0.000141 M and about 0.000282 M. It should be appreciated that the concentration of the chemical brightener component of the copper plating solution can essentially be adjusted to any value up to the solubility limit of the chemical brightener as long as the nucleation enhancing properties of the chemical brightener is maintained in the resulting copper plating solution to allow for a sufficiently dense deposition of copper on the wafer surface.

In one embodiment, the polyamine-based complexing agent is a diamine compound. Examples of diamine compounds that can be utilized for the solution include ethylenediamine, propylenediamine, 3-methylenediamine, and mixtures thereof. In another embodiment, the polyamine-based complexing agent is a triamine compound. Examples of triamine compounds that can be utilized for the solution include diethylenetriamine, dipropylenetriamine, ethylenepropylenetriamine, and mixtures thereof. In still another embodiment, the polyamine-based complexing agent is an aromatic or cyclic polyamine compound. Examples of aromatic polyamine compounds include benzene-1,2-diamine, pyridine, dipyride, pyridine-1-amine. It should be understood that essentially any diamine, triamine, or aromatic polyamine compound can be used as the complexing agent for the plating solution so long as the compound can complex with the free metal ions in the solution (i.e., copper(II) metal ions and cobalt(II) metal ions), be readily solubilized in the solution, and be protonized in an acidic environment. In one embodiment, other chemical additives including accelerators (i.e., sulfopropyl sulfonate) and suppressors (i.e., PEG, polyethylene glycol) are included in the copper plating solution at low concentrations to enhance the application specific performance of the solution.

In another embodiment, the concentration of the complexing agent component of the copper plating solution is maintained at between about 0.0001 molarity (M) and the solubility limit of the various diamine-based, triamine-based, and aromatic or cyclic polyamine complexing agent species disclosed above. In one exemplary embodiment, the concentration of the complexing agent component of the copper plating solution is maintained at between about 0.005 M and 10.0 M, but must be greater than the total metal concentration in solution.

Typically, the complexing agent component of a copper plating solution causes the solution to be highly alkaline and therefore somewhat unstable (due to too large a potential difference between the copper(II)-cobalt(II) redox couple). In one exemplary embodiment, an acid is added to the plating solution in sufficient quantities to make the solution acidic with a pH≦about 6.4. In another embodiment, a buffering agent is added to make the solution acidic with a pH≦about 6.4 and to prevent changes to the resulting pH of the solution after adjustment. In still another embodiment, an acid and/or a buffering agent is added to maintain the pH of the solution at between about 4.0 and 6.4. In yet another embodiment, an acid and/or a buffering agent is added to maintain the pH of the solution at between about 4.3 and 4.6. In one embodiment, the anionic species of the acid matches the respective anionic species of the copper(II) and cobalt(II) salt components of the copper plating solution, however it should be appreciated that the anionic species do not have to match. In yet another embodiment, a pH modifying substance is added to make the solution weakly alkaline, i.e., a pH of less than about 8.

Acidic copper plating solutions have many operational advantages over alkaline plating solutions when utilized in an electroless copper deposition application. An acidic copper plating solution improves the adhesion of the reduced copper ions that are deposited on the wafer surface. This is often a problem observed with alkaline copper plating solutions due to the formation of hydroxyl-terminated groups, inhibiting the nucleation reaction and causing reduced nucleation density, larger grain growth and increased surface roughness. Still further, for applications such as direct patterning of copper lines by electroless deposition of copper through a patterned film, an acidic copper plating solution helps improve selectivity over the barrier and mask materials on the wafer surface, and allows the use of a standard positive resist photomask resin material that would normally dissolve in a basic solution.

In addition to the advantages discussed above, copper deposited using the acidic copper plating solutions exhibits lower pre-anneal resistance characteristics than with copper deposited using alkaline copper plating solutions. It should be appreciated that the pH of the copper plating solutions, as disclosed herein, can essentially be adjusted to any acidic (i.e., pH<7.0) environment so long as the resulting deposition rates of copper during the electroless copper deposition process is acceptable for the targeted application and the solution exhibits all the operational advantages discussed above. In general, as the pH of the solution is lowered (i.e., made more acidic), the copper deposition rate decreases. However, varying the choice of complexing agent (e.g., diamine-based, triamine-based, aromatic polyamine, etc.) plus the concentration of the copper (II) and cobalt(II) salts can help compensate for any reduction in copper deposition rate resulting from an acidic pH environment.

In one embodiment, the copper plating solution is maintained at a temperature between about 0° Celsius (° C.) and 70° C. during an electroless copper deposition process. In one exemplary embodiment, the copper plating solution is maintained at a temperature of between about 20° C. and 70° C. during the electroless copper deposition process. It should be appreciated that temperature impacts the nucleation density and deposition rate of copper (mainly, the nucleation density and deposition rate of copper is directly proportional to temperature) to the wafer surface during copper deposition. The deposition rate impacts the thickness of the resulting copper layer and the nucleation density impacts void space, occlusion formation within the copper layer, and adhesion of the copper layer to the underlying barrier material. Therefore, the temperature settings for the copper plating solution during the electroless copper deposition process would be optimized to provide dense copper nucleation and controlled deposition following the nucleation phase of the bulk deposition to optimize the copper deposition rate to achieve copper film thickness targets.

FIG. 1 is a flow chart of a method for preparing an electroless copper plating solution, in accordance with one embodiment of the present invention. Method 100 begins with operation 102 where the anhydrous copper salt component, a portion of the polyamine-based complexing agent, the chemical brightener component, the halide component, and a portion of the acid component of the copper plating solution are combined into a first mixture. The method 100 proceeds on to operation 104 where the remaining portion of the complexing agent and the anhydrous cobalt salt component are combined into a second mixture. In one embodiment, the pH of the second mixture is adjusted so that the second mixture has an acidic pH. It should be appreciated that the advantage of keeping the second mixture acidic is that this will keep the cobalt (II) in an active form. The method 100 then continues on to operation 106 where the first mixture and the second mixture are combined into the final copper plating solution prior to use in a copper plating operation utilizing the system described below.

In one embodiment, the first and the second mixtures are stored in separate permanent storage containers prior to integration. The permanent storage containers being designed to provide transport and long-term storage of the first and second mixtures until they are ready to be combined into the final copper plating solution. Any type of permanent storage container may be used as long as the container is non-reactive with any of the components of the first and the second mixtures. It should be appreciated that this pre-mixing strategy has the advantage of formulating a more stable copper plating solution that will not plate out (that is, resulting in the reduction of the copper) over time in storage.

The embodiments can be further understood in reference to Example 1 which describes a sample formulation of copper plating solution, in accordance with one embodiment of the present invention.

EXAMPLE 1

Nitrate-Based Copper Plating Formulation

In this embodiment, a nitrate-based formulation of the copper plating solution is disclosed with a pH of 6.0, a copper nitrate ($Cu(NO_3)_2$) concentration of 0.05M, a cobalt nitrate ($Co(NO_3)_2$) concentration of 0.15M, an ethylenediamine (i.e., diamine-based complexing agent) concentration of 0.6M, a nitric acid ($HNO_3$) concentration of 0.875M, a potassium bromide (i.e., halide component) concentration of 3 millimolarity (mM), and a SPS (i.e., chemical brightener) concentration of between about 0.000141 M and about 0.000282 M. The resulting mixture is then deoxygenated using Argon gas to reduce the potential for the copper plating solution to become oxidized.

Continuing with Example 1, in one embodiment, the nitrate-based formulation of the copper plating solution is prepared using a pre-mixing formulation strategy that involves pre-mixing a portion of the ethylenediamine with the copper nitrate, the nitric acid, and the potassium bromide into a into a first pre-mixed solution. The remaining portion of the complexing agent component is pre-mixed with the cobalt salt component into a second pre-mixed solution. The first premixed solution and second pre-mixed solution are then added into an appropriate container for final mixing into the final electroless copper plating solution prior to use in an electroless copper deposition operation. As disclosed above, this pre-mixing strategy has the advantage of formulating a more stable copper plating solution that will not plate out over time in storage. Additionally, all fluids used in the processes disclosed herein may be de-gassed, i.e. dissolved oxygen is removed by commercially available degassing systems. Exemplary inert gases used for degassing include nitrogen ($N_2$), helium (He), neon (Ne), argon (Ar), krypton (Kr), and xenon (Xe).

As mentioned above, electroless deposition of copper or other metal layers by high alkaline pH chemistry is well known in the industry. Typical chemistries utilize a copper salt, a complexing agent, a metal salt where the metal (Me) has the correct copper-Me redox couple that favors reduction of copper and oxidation of the Me to facilitate the electroless plating process. Usually the process of electroless copper deposition using cobalt (II) as a reducing agent proceeds without any retardations in chloride salt solutions. Many of the typical electroless deposition solutions utilize an aqueous base solution. However, for certain metal layers, the addition of water may cause oxidation of the layer, which is undesirable. For example, tantalum (Ta) layers experience this oxidation with aqueous base solutions. The embodiments described below provide for non-aqueous plating formulations that may either be acidic, neutral, or basic. It should be appreciated that the formulations may be provided to plate on copper, tantalum, or other surfaces.

In the additional embodiments described below, electroless copper plating solutions using non-aqueous solvents and ethylenediamine as a complexing agent are provided. The plating solutions described herein may also be utilized to deposit a layer of material over other barrier layers besides copper commonly used in semiconductor manufacturing processes. For example, tantalum barrier layers may be used as a base layer over which the following electroless plating solutions deposit a certain layer of material. Described below is an experimental example in which an electroless copper plating solution was used for plating a copper layer. Ethylenediamine was utilized as a complexing agent and the solvents used for the experiment were non-aqueous. Exemplary non aqueous solvents are listed in Table 7. Essentially, any non aqueous solvent capable of dissolving copper or ethylendiamine may be utilized with the embodiments described herein.

In one embodiment, the surface to be plated was a copper foil substrate which was pre-treated as follows: The surface was pretreated with a Vienna lime (calcium carbonate) and acid solution and then rinsed with distilled water. In one embodiment, a plasma cleaning of the copper foil may be performed instead of the Vienna lime and acid solution. In optional embodiments, the surface of the copper foil may be polished for about sixty seconds in a solution of a chemical polishing material. In one embodiment, the chemical polishing solution is sulfuric acid with hydrogen peroxide. The treated foil was then again rinsed with distilled water. It should be appreciated that the chemical polishing solution is an optional operation and not required. The surface was then activated for sixty seconds in one gram per liter of $PdCl_2$ solution containing ten milliliters per liter of concentrated hydrochloric acid (HCl). In this operation the surface is functionalized so that the copper grows on the functionalized surface, i.e., the Pd catalyst. The surface of the foil was then rinsed with distilled water and dried. The surface may be cleaned through alternative methods or may not be cleaned at all, as the cleaning method is exemplary and not meant to be limiting. The non-aqueous solution for electroless copper plating was then prepared as follows:

EXAMPLE 2

0.051 grams of $CuCl_2$ was dissolved in four milliliters (ml) of dimethyl sulfoxide (DMSO). The dissolving was performed under moderate heating in order to accelerate the dissolution. It should be appreciated that the $CuCl_2$ is an anhydrous composition. Then, from 0.2 to 0.7 milliliters of concentrated hydrochloric acid was added to the mixture. It should be appreciated that the hydrochloric acid used was also anhydrous. In one embodiment, acetic acid may be used in place of the hydrochloric acid as described below. Next, 0.63 milliliters of 11.45 molar (M) ethylenediamine is added. At this point, the solution described above is referred to as Solution A. A second solution, referred to as Solution B was prepared with 0.214 grams of $CoCl_2$ which was dissolved in (6-X) milliliters of DMSO, where X is the volume of hydrochloric acid used for the preparation of Solution A. Here again, moderate heating was provided in order to accelerate the dissolution. It should be appreciated that the $CoCl_2$ was the anhydrous form of the material. In one embodiment, Solution A is deaerated by argon bubbling but this deaeration is optional.

Solution A and Solution B are kept separate until prior to performing the electroless copper plating procedure. Once the electroless copper plating procedure is about to initiate, Solution A and Solution B are mixed together and the final volume was brought up to 10 milliliters with the non-aqueous solvent, which in this example is DMSO. In this exemplary embodiment, the final concentration of solution for the electroless copper plating is as follows: 0.03M Cu(II), 0.09M Co(II) and 0.72M of ethylenediamine. These molar compositions may vary. For example, as mentioned above, the composition of the Cu(II) may range from 0.01 M up to the solubility limit of the Copper salt in the solvent. The concentration of the Co(II) may range from 0.01 M to up to the solubility limit. In on embodiment, the concentration of the Co(II) is at least two times the concentration of the Cu(II). In another embodiment, the concentration of the complexing agent is at least the sum of the Cu(II) and the Co(II) concentrations. The pretreated and activated copper foil was immersed into the electroless copper plating solution for 30 minutes. The plating procedure was performed at 30 degrees C. in a closed reaction vessel while bubbling argon through the solution. The thickness of the copper films was found to be pH dependent and is documented in Table I.

TABLE 1

| | Solution composition (mol/l): $CuCl_2$ 0.025, En-0.6, $CoCl_2$ 0.075 | | Solution composition (mol/l): $CuCl_2$-0.05, En-1.2, $CoCl_2$-0.15. | |
|---|---|---|---|---|
| [HCl], ml/l | Approx. pH | μm Cu/30 min | Approx. pH | μm Cu/30 min |
| 10.0 | 10.4 | 0 | 10.7 | 0 |
| 15.0 | 10.2 | 0.11 | 10.5 | 0.11 |
| 20.0 | 9.6 | 0.11 | 10.3 | 0.11 |
| 25.0 | 9.2 | 0.11 | 10.2 | 0.11 |
| 30.0 | 8.8 | 0.22 | 10.0 | 0.14 |
| 33.0 | 8.5 | 0.30 | | |
| 35.0 | 8.2 | 0.17 | 9.8 | 0.31 |
| 40.0 | 7.9 | 0.14 | 9.7 | 0.20 |
| 50.0 | 7.6 | 0.17 | 9.1 | 0.22 |
| 55.0 | | | 8.8 | 0.39 |
| 60.0 | 6.8 | 0.03 | 8.5 | 0.25 |
| 70.0 | 6.2 | 0 | 8.2 | 0.11 |
| 80.0 | | | 7.8 | 0.03 |

Table I provides two sets of solutions with different concentrations of components used for the chloride electroless copper plating solutions. It should be appreciated that when using lower concentrations of electroless copper plating solution components, (0.025 mol/l) of copper chloride, it was found that at the highest pH (pH=10.4) and the lowest pH, (pH=6.2) the solutions were stable, but no copper deposition was observed. That is, the copper deposition occurred between about pH 6.2 to about pH 10.4. Starting from approximately pH=10.2, electroless copper deposition begins and proceeds with about the same rate, i.e., 0.11 micrometers per 30 minutes, up to pH=9.2. As the solution pH further decreases, the results increase in plating rate, but the instability of the solution appears to increase also. It should be noted that higher concentration of components of electroless copper deposition solutions allows to obtain higher plating rates under conditions of stable solutions—the highest plating rate reaches 0.31 μm/30 min, i.e., it is ca. 3 times higher comparing with the solution having the lower concentration of solution components. For the higher concentration solution, the plating rate at pH 8.8 was 0.39 μm/30 min, however, the solution was not as stable as at pH 9.8 where the rate was 0.31.

As an alternative to the chloride system described above, an acetate system was also reviewed. It should be appreciated that the use of acetates incorporate the use of acetic acid, which does not contain water for the non-aqueous embodiments described herein. In addition, the acetic acid is a desirable solvent of polar molecules and can be used for preparations of concentrated stock solutions of copper(I) acetate and cobalt(II) acetate. In the embodiments reviewed herein, the copper(II) acetate is dissolved in ethylene glycol. Through the embodiments described in the tables below, an electroless copper plating solution with the addition of an accelerator was found to initiate the electroless copper plating process from acetate solutions. In one embodiment, the accelerator is a halide, such as bromine, fluorine, iodine, and chlorine. In another embodiment, the addition of one millimole of the halogen, such as bromine, is provided from a source such as $CuBr_2$. Table 2 illustrates the dependence of electroless copper plating rates on solution pH and the concentration of ethylene diamine in ethylene glycol as the non aqueous solvent.

TABLE 2

| | Solution composition (mol/l): $Cu(CH_3COO)_2$-0.025, $CuBr_2$-0.001, En-0.3, $Co(CH_3COO)_2$-0.075 | | Solution composition (mol/l): $Cu(CH_3COO)_2$-0.025, $CuBr_2$-0.001, En-0.6, $Co(CH_3COO)_2$-0.075 | |
|---|---|---|---|---|
| $[CH_3COOH]$, ml/l | Approx. pH | μm Cu/30 min | Approx. pH | μm Cu/30 min |
| 0 | 9.8 | 0.11 | | |
| 5.0 | 7.7 | 0.06 | | |
| 10.0 | 6.7 | 0.03 | | |
| 20.0 | 6.3 | 0.06 | | |
| 25.0 | 6.2 | 0.08 | | |
| 30.0 | 6.1 | 0 | 8.0 | 0.06 |
| 35.0 | | | 7.7 | 0.11 |
| 40.0 | | | 7.3 | 0.18 |
| 45.0 | | | 6.9 | 0.28 |
| 50.0 | | | 6.8 | 0.25 |
| 55.0 | | | 6.6 | 0.22 |
| 60.0 | | | 6.5 | 0.28 |
| 70.0 | | | 6.3 | 0.06 |

Table 3 illustrates the dependence of electroless copper plating rates on solution pH at lower concentrations of components in ethylene glycol at 30 degrees C. Solution composition (mol/l): for the data of Table 3 was $Cu(CH_3COO)_2$—0.0125, $CuBr_2$—0.001, $Co(CH_3COO)_2$—0.0375, En—0.3.

TABLE 3

| $[CH_3COOH]$, ml/l | Approx. pH | μm/30 min |
|---|---|---|
| 0 | 11.0 | 0 |
| 10.0 | 8.2 | 0.28 |
| 20.0 | 7.0 | 0.11 |

TABLE 3-continued

| [$CH_3COOH$], ml/l | Approx. pH | μm/30 min |
|---|---|---|
| 30.0 | 6.3 | 0.03 |
| 40.0 | 5.9 | 0 |

Two concentrations of ethylenediamine were tested for formulation of solutions of electroless copper plating. Using 0.3 mol/l of ethylenediamine, a stable solution was obtained for alkaline compositions of the plating solution (Table 2), and the plating rate was relatively low at 0.11 μm Cu/30 min. At lower pH's solutions were unstable, and at pH 6.1 solution becomes stable, but no plating process occurs (Table 2). At twice higher concentration of ethylenediamine (0.6 mol/L) the pH limits of solution stability are broadened and solutions are stable in pH region from 8.0 to 6.8 (Table 2). The highest plating rate was obtained at pH 6.9 (0.28 μm Cu/30 min). Thus, higher deposition rates were achieved as higher concentrations of the complexing agent, e.g., ethylenediamine, were used. It should be appreciated that the acidity of the plating solution may be changed by manipulating the amount of acid or the amount of complexing agent. In one embodiment, the more complexing agent added, the more basic the solution becomes.

The use of more diluted solutions is also possible and the plating rate of 0.28 μm Cu/30 min can be achieved at pH 8.2 solution being stable (Table 3).

In one embodiment, ultrasonic irradiation was applied to the solutions during the electroplating. The experiments performed showed an increase in the plating rate reaching 10-30%. However, solutions which were stable under conditions without ultrasonic irradiation, become unstable after 10-20 min of plating.

Another parameter effecting the plating rate is the temperature of plating solutions. In one embodiment, the elevation of temperature increases the copper deposition rate due to two reasons. The activation energy of the process diminishes, and the viscosity of solutions also decreases with an increase in temperature so that diffusion processes are accelerated.

Figure 2:
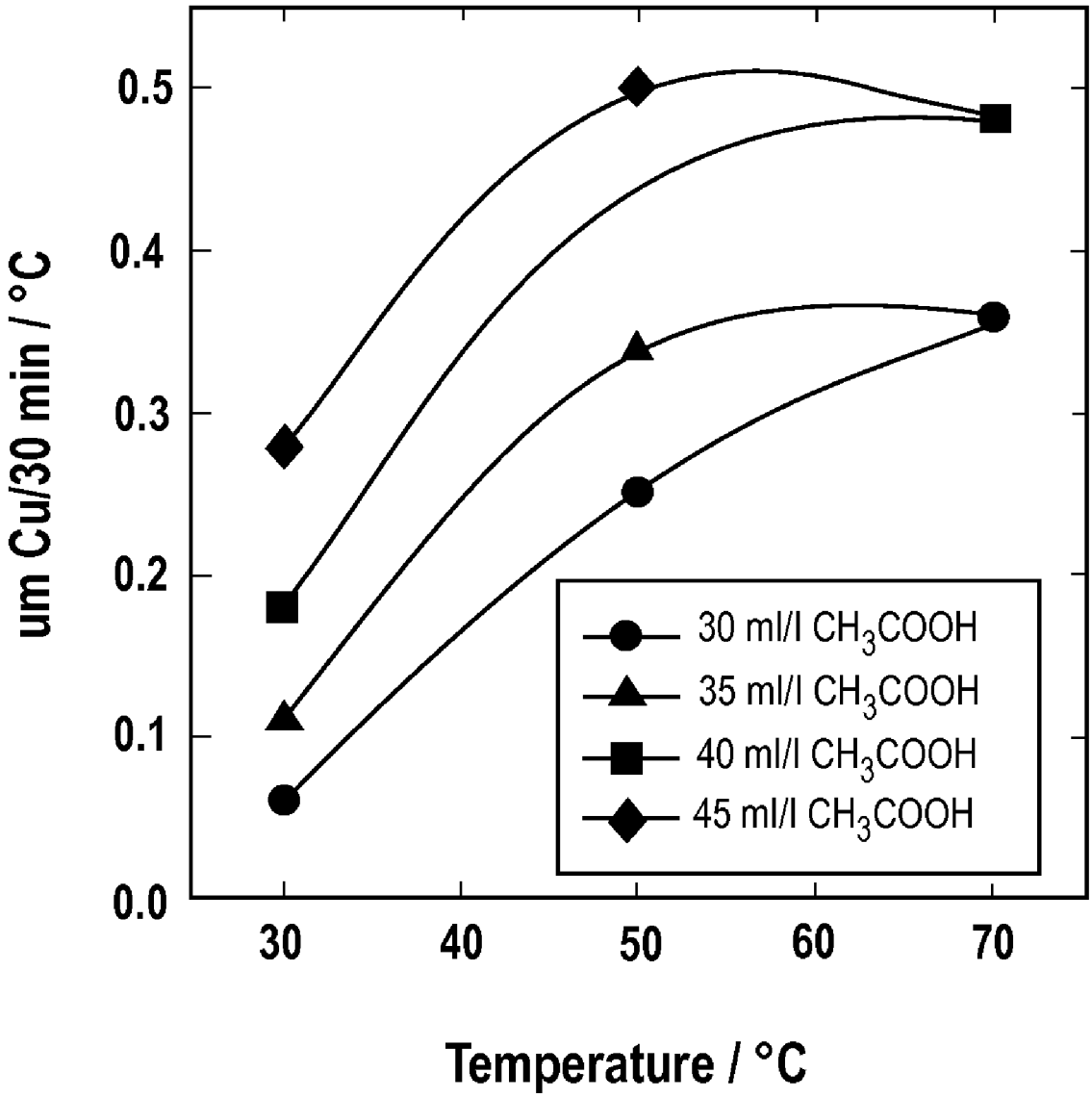
FIG. 2 is a graphical illustration of the dependence of the electroless copper plating rate on temperature in accordance with one embodiment of the invention.

The dependence of electroless copper plating rate on temperature from stable solutions was evaluated and graphically illustrated in FIG. 2. As illustrated, the elevation of temperature is most effective in the range from 30 to 50° C. The further increase in temperature from 50 to 70° C. effects the plating rate less.

Dependence of electroless copper plating rate on solution pH and temperature is tabulated in Table 4. The solution composition (mol/l) was as follows: $Cu(CH_3COO)_2$—0.025, $CuBr_2$—0.001, $Co(CH_3COO)_2$—0.075, En—0.6. Table 4 shows a general trend of acceleration of copper deposition with the elevation of temperature. It is worth to noting that the highest plating rates (up to 0.67 μm Cu/30 min) can be obtained at 70° C. as long as the solution is stable.

TABLE 4

| | 30° C. | | 50° C. | | 70° C. | |
|---|---|---|---|---|---|---|
| [$CH_3COOH$], ml/l | Approx. pH | μm/ 30 min | Approx. pH | μm/ 30 min | Approx. pH | μm/ 30 min |
| 30.0 | 8.0 | 0.06 | 7.9 | 0.25 | 7.7 | 0.36 |
| 35.0 | 7.7 | 0.11 | 7.3 | 0.34 | 7.6 | 0.36 |
| 40.0 | 7.3 | 0.18 | 7.0 | 0.44 | 7.1 | 0.48 |
| 45.0 | 6.9 | 0.28 | 6.9 | 0.50 | 6.9 | 0.48 |
| 50.0 | 6.8 | 0.25 | 6.6 | 0.42 | 6.7 | 0.48 |

TABLE 4-continued

| | 30° C. | | 50° C. | | 70° C. | |
|---|---|---|---|---|---|---|
| [$CH_3COOH$], ml/l | Approx. pH | μm/ 30 min | Approx. pH | μm/ 30 min | Approx. pH | μm/ 30 min |
| 55.0 | 6.6 | 0.22 | 6.5 | 0.33 | 6.4 | 0.48 |
| 60.0 | 6.5 | 0.28 | 6.5 | 0.64 | 6.3 | 0.67 |
| 65.0 | | | 6.1 | 0.56 | 6.1 | 0.56 |
| 68.0 | | | 6.0 | 0.40 | | |
| 70.0 | 6.3 | 0.06 | 6.0 | 0.36 | 6.1 | 0.42 |
| 80.0 | | | 5.9 | 0.14 | 6.0 | 0.67 |
| 90.0 | | | | | 5.9 | 0.17 |
| 100.0 | | | | | 5.7 | 0.20 |

Table 5 illustrates the dependence of electroless copper plating rate on solution pH in ethyleneglycol at 25° C. Solution composition (mol/l): Cu(CH3COO)2.—0.05, Co(CH3COO)2.—0.15, Pn—0.6. As illustrated in Table 5, the concentration of the accelerator (potassium bromide) impacts the plating rate also.

TABLE 5

| $CH_3COOH$ diluted with ethyleneglycol (final concentration 5.6 mol/l), ml/l | Approx. pH | KBr, mmol/l | μm Cu/30 min |
|---|---|---|---|
| 0 | | 0 | 0 |
| 0.05 | 8.5 | 2 | 0.06 |
| 0.05 | 8.5 | 5 | 0.06 |
| 0.05 | 8.5 | 7.5 | 0.08 |
| 0.1 | 8.1 | 2 | 0.06 |
| 0.1 | 8.2 | 5 | 0.14 |
| 0.1 | 8.3 | 6 | 0.14 |
| 0.1 | 8.5 | 7.5 | 0.14 |
| 0.2 | 7.8 | 2 | 0.11 |
| 0.2 | 7.9 | 5 | 0.16 |
| 0.5 | 7.2 | 2 | 0.06 |
| 0.5 | 7.1 | 4 | 0.11 |
| 1.0 | 6.4 | 4 | 0.14 |
| 2.0 | 5.7 | 4 | 0.06 |
| 2.3 | 5.8 | 5 | 0.06 |
| 2.6 | 5.8 | 5 | 0.03 |
| 3.0 | 5.5 | 4 | 0 |
| 3.0 | 5.5 | 10 | 0.03 |

Table 6 illustrates the dependence of the electroless copper plating rate on solution pH in ethyleneglycol at 60° C. Solution composition (mol/l): Cu(CH3COO)2.—0.05, Co(CH3COO)2.—0.15, Pn—0.6.

TABLE 6

| Icy $CH_3COOH$ diluted with ethyleneglycol (final concentration 5.6 mol/l), ml/l | pH | KBr, mmol/l | μm Cu/30 min |
|---|---|---|---|
| 0.1 | 8.1 | 5 | 0.25 |
| 0.2 | 7.8 | 5 | 0 |
| 2.3 | 5.9 | 5 | 0.06 |
| 2.6 | 5.8 | 5 | 0.08 |
| 3.0 | 5.5 | 5 | 0.22 |

In other embodiments, electroless copper plating solutions may be used with propylenediamine as the complexing agent in place of ethylenediamine. In addition, alternative non-aqueous solvents such as propylene glycol may be used for the embodiments. Further solvents are illustrated in Table 7.

TABLE 7

| Solvent |
|---|
| Methanol |
| Ethanol |
| Butanol |
| Isopropanol |
| 1,4-dioxane |
| Diethylether |
| 1,2-dichlorethane |
| Tetrachlormethane |
| Pyridine |
| Toluene |
| Hexane |
| Cyclohexane |
| Acetone |
| Acetonitrile |
| Dimethylformamide |
| 2-butene-1,4-diol |
| Dimethylsulfoxide |
| Ethyleneglycol |
| Propanediol |

Table 7 lists a portion of non-aqueous solvents which may be utilized with the embodiments described herein. In one embodiment, polar non-aqueous solvents may be used for the electroless copper plating solution described herein. It should be appreciated that other compounds from the families listed in Table 7 may be utilized with the embodiments described herein. As mentioned above, any suitable non-aqueous solvents capable of dissolving the copper and the complexing agent may be utilized. In addition to the specific embodiments listed above for the chloride and acetate systems, nitrate and sulfate systems may also be used with the embodiments described herein. In the nitrate system, copper nitrate, cobalt nitrate, and nitric acid may be utilized with the complexing agents and non aqueous solvents described herein. In the sulfate system, the copper and cobalt sulfate components mentioned previously, along with sulfuric acid may be included.

Although a few embodiments of the present invention have been described in detail herein, it should be understood, by those of ordinary skill, that the present invention may be embodied in many other specific forms without departing from the spirit or scope of the invention. It should be appreciated, that the exemplary compounds for the reducing agents, ion sources, complexing agents, etc., listed for the acidic formulation may be incorporated to the non-aqueous formulation. Therefore, the present examples and embodiments are to be considered as illustrative and not restrictive, and the invention is not to be limited to the details provided therein, but may be modified and practiced within the scope of the appended claims.

What is claimed is:

1. A non-aqueous electroless copper plating solution, comprising;

an anhydrous copper salt component;

an anhydrous cobalt salt component;

a non-aqueous complexing agent;

potassium bromide; and a non-aqueous solvent.

2. The solution of claim 1, wherein the anhydrous copper salt component is selected from the group consisting of copper chloride, copper acetate, copper nitrate and copper sulfate.

3. The solution of claim 1, wherein the anhydrous cobalt salt component is selected from the group consisting of cobalt chloride, cobalt acetate, cobalt nitrate and cobalt sulfate.

4. The solution of claim 1 wherein the non-aqueous solvent is a polar solvent.

5. The solution of claim 1 wherein the non-aqueous solvent is a non-polar solvent.

6. The solution of claim 1 wherein the non-aqueous complexing agent is one of ethylenediamine or polypropylenediamine.

7. A non-aqueous electroless copper plating solution, comprising;

an anhydrous copper salt component;

an anhydrous cobalt salt component;

a polyamine complexing agent;

a halide source;

a pH modifying substance selected from the group consisting of anhydrous compositions of sulfuric acid, hydrochloric acid, nitric acid, acetic acid, and fluoroboric acid; and a non-aqueous solvent.

8. The solution of claim 7, wherein the polyamine complexing agent is non-aqueous.

9. The solution of claim 7, wherein the polyamine complexing agent is selected from the group consisting of a diamine compound, a triamine compound, and an aromatic polyamine compound.

10. The solution of claim 7, wherein the halide source is potassium bromide.

11. The solution of claim 7, wherein the solution is basic.

12. The solution of claim 7, wherein the solution is acidic.

13. The solution of claim 7, wherein a concentration of the anhydrous copper salt component is between about 0.01 molar to a solubility limit for the non aqueous copper salt.

14. The solution of claim 7, wherein a concentration of the anhydrous cobalt salt component is between about 0.01 molar to a solubility limit for the non aqueous cobalt salt.

15. The solution of claim 7, wherein a concentration of the polyamine complexing agent is at least as great as a sum of a concentration of the anhydrous copper salt component and a concentration of the anhydrous cobalt salt component.

16. The solution of claim 7, wherein the non-aqueous solvent is a polar solvent.

17. The solution of claim 7, wherein the non-aqueous solvent is a non- polar solvent.

18. A non-aqueous electroless copper plating solution, comprising;

an anhydrous copper salt component;

an anhydrous cobalt salt component;

a non-aqueous complexing agent;

a halide source; and a non-aqueous solvent, wherein the solution is acidic.

* * * * *